United States Patent [19]

Garber et al.

[11] 4,097,156

[45] Jun. 27, 1978

[54] REAL-TIME SYSTEM FOR AUTOMATICALLY MEASURING THE PERFORMANCE OF WEAPONS

[75] Inventors: Arnold L. Garber; Hans H. Cremer, both of San Jose, Calif.

[73] Assignee: FMC Corporation, San Jose, Calif.

[21] Appl. No.: 767,729

[22] Filed: Feb. 11, 1977

[51] Int. Cl.[2] ..... G01B 11/26; F41F 27/00

[52] U.S. Cl. ..... 356/152; 35/25; 89/41 L; 273/101.1

[58] Field of Search ..... 89/41 L; 346/38; 35/25; 356/152; 273/101.1

[56] References Cited

U.S. PATENT DOCUMENTS

| | | | |
|---|---|---|---|
| 3,083,474 | 4/1963 | Knapp | 35/25 |
| 3,169,191 | 2/1965 | Knapp | 89/41 L |
| 3,888,022 | 6/1975 | Pardes et al. | 35/25 |
| 3,955,292 | 5/1976 | Robertsson | 35/25 |
| 3,964,178 | 6/1976 | Marshall et al. | 35/25 |

*Primary Examiner*—S. C. Buczinski

*Attorney, Agent, or Firm*—R. S. Kelly; L. B. Guernsey; C. E. Tripp

[57] ABSTRACT

A xenon flash lamp mounted on a target flashes at a rate which is determined by the frequency of an oscillator also mounted on the target. A detector assembly which is mounted on a gun receives flashes of light from the lamp only when the gun is aligned with the target. The detector assembly includes a photodetector which produces an electrical signal pulse for each flash of light received. A local oscillator mounted near the gun and tuned to the frequency of the oscillator at the target produces voltage pulses at the same frequency as the frequency of the light flashes from the target. A counter connected to the photodetector counts the number of pulses of light received over a given period of time. Another counter connected to the local oscillator counts the number of voltage pulses received over the same period of time. The readings of the counters are processed by an electronic divider circuit to produce a signal which is proportional to the percent of time that the gun is aligned with the target.

10 Claims, 4 Drawing Figures

REAL-TIME SYSTEM FOR AUTOMATICALLY MEASURING THE PERFORMANCE OF WEAPONS

BACKGROUND OF THE INVENTION

1. Field of the Invention

The present invention pertains to a system for evaluating the performance of weapons, and more particularly, it pertains to a system for automatically measuring the percent of time that a gun is accurately aimed at a target.

2. Description of the Prior Art

Weapons which are mounted on movable carriers, such as warships and combat tanks, require the use of a weapons stabilizing system to aid in keeping the guns aimed toward a desired target. Otherwise, the pitch and roll of the ship or movement of the tank over rough terrain may cause the shells fired from the guns to miss the targets. There are several different types of stabilizing systems which have been used to aid in keeping the guns aimed toward the target, and it is important to be able to evaluate the reliability and accuracy of these stabilizing systems.

One prior art method of evaluating a weapons stabilizing system is to mount a movie camera on the gun being evaluated with a crosshair of the camera aligned with the barrel of the gun. The gun, camera and stabilizing system are mounted on a movable carrier which traverses a prescribed course while movies are taken which show the orientation of the camera crosshairs relative to the target. At the conclusion of the tests, the film is developed and analyzed on a frame-by-frame basis. This is a slow, tedious procedure requiring a special motion-analysis movie projector. It may require a period of several days, or even several weeks, to perform the tests, to develop the film, and then analyze the results.

Another method for evaluating weapon performance is disclosed in a prior art U.S. Pat. No. 3,083,474 to Knapp. The Knapp patent discloses an optoelectronic system for evaluating weapon performances wherein a light source is provided at the target and wherein the weapon includes a photodetector and an optical system to direct light to the photodetector when the weapon is aligned with the target. This system uses an RF transmitter on the weapon to provide an RF signal which causes the target to project a light beam only when the weapon is fired, i.e., when the trigger is pulled. Means are then provided to indicate a "hit" if the detector receives a light pulse during the "firing" of the weapon. However, this patent does not disclose any means for continuously evaluating the direction of the orientation of the gun which is being tested.

Another prior art U.S. Pat. No. 3,888,922 to Pardes discloses an electro-optical weapons training system wherein a pulsed laser beam is directed from a weapon to a photodetector on a target. The number of "attempts" and the number of "hits" are recorded and displayed.

SUMMARY OF THE INVENTION

The system of the present invention provides a real-time evaluation of the performance of weapons by measuring the percent of time a weapon is trained on a target and by providing a numerical evaluation as soon as the actual testing is completed. The system includes a pulsating light source mounted on the target and means for energizing the light source at a predetermined pulse rate. Means, located at the weapon, are provided for receiving radiant energy from the pulsating light source only when the weapon is aimed at the target and for counting the number of flashes of radiant energy that are thus received during the weapon evaluation time period. The invention also includes means for counting the pulses produced at said predetermined pulse rate during said weapon evaluation time period and for comparing this count with the count determined by the number of received flashes in order to provide a continuous time-on-target reading.

DESCRIPTION OF THE PREFERRED EMBODIMENT

Figure 1:
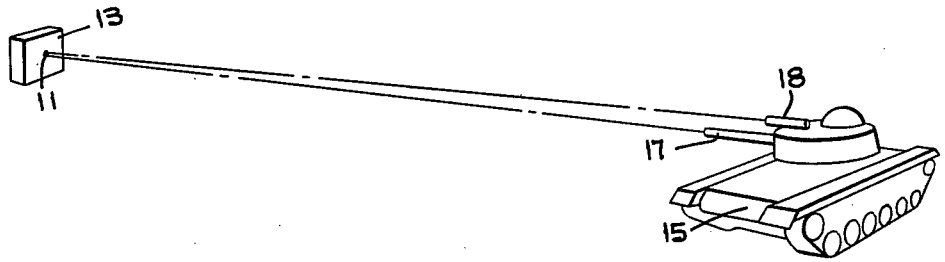
FIG. 1 is a diagrammatic drawing of the manner in which the weapon evaluation system of the present invention is utilized.

Referring now more particularly to the drawings, FIG. 1 is a diagrammatic representation of the application of the weapon evaluating system of the present invention. The system includes a flash lamp 11 mounted on a target 13, a detector assembly 18 carried by a gun 17 of a combat tank 15, and the control circuitry for correlating the lamp and detector operations.

The detector assembly 18 includes a cylindrical tube 19 closed at one end (FIG. 2) which is securely mounted atop the gun barrel (by means not shown) with its longitudinal axis aligned parallel to the axis of the gun barrel so that the detector assembly will be pointed (approximately) directly at the target 13 at the same time that the gun 17 is pointed at the target. Received within the tube 19 at its open end is an objective lens 26. The detector assembly 18 also includes an opaque mask 28 mounted within tube 19 in the focal plane of the lens 26 and a photodiode 30 mounted directly behind the mask. The opaque mask 28 includes a centered transparent aperture 32 constructed in the same projected shape as that of the target and of a size such that the focused target image from the lens 26 will exactly coincide with the aperture at the normal target practice range, i.e., the distance between the gun 17 and the target 13. When the detector assembly is aligned with the target, an image of the flash lamp is formed within the aperture 32, and the radiant energy from the flash lamp is incident on the photodiode 30. An amplifier 43, mounted adjacent the photodiode 30, amplifies signals which are developed by the photodiode when the light beam from the flash lamp is detected by the photodiode.

Figure 3:
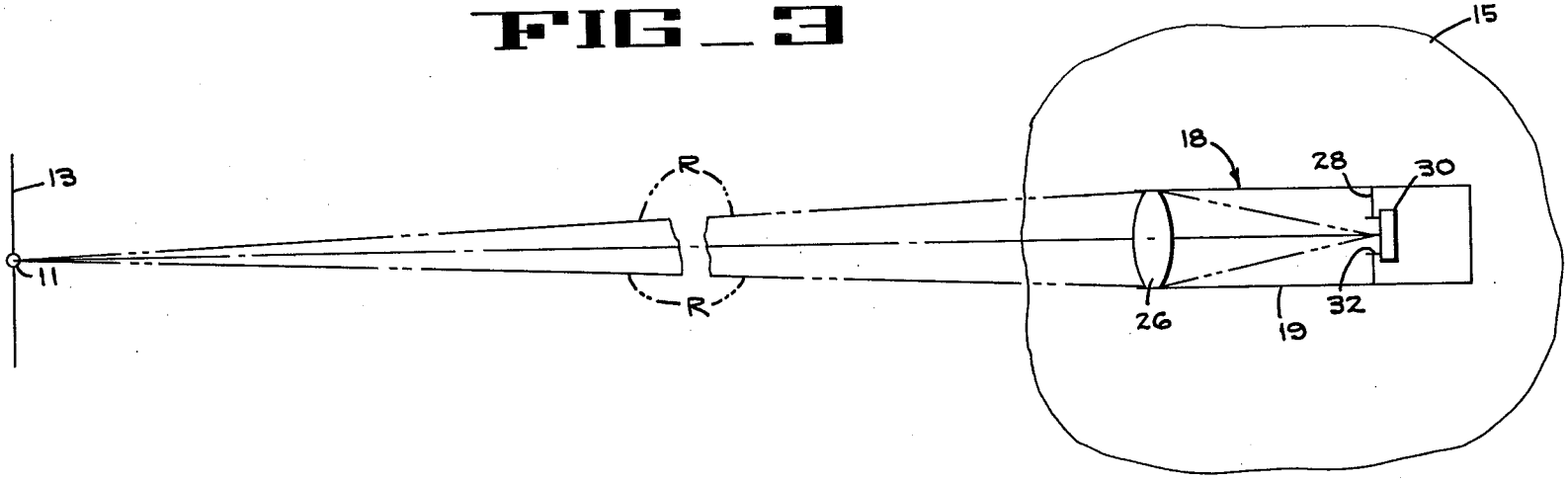
FIG. 3 is a diagrammatic illustration of the detector assembly of the present invention and illustrates the optical alignment when the detector assembly is aimed at the target.
Figure 4:
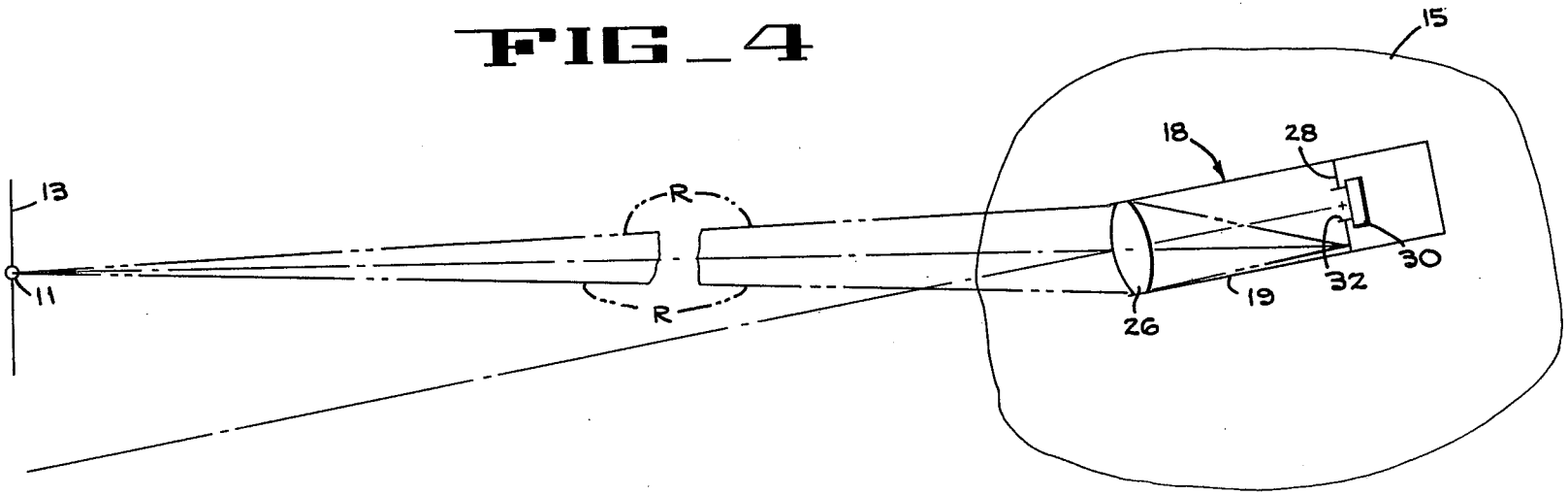
FIG. 4 is a diagrammatic illustration of the detector assembly similar to FIG. 3 but illustrating the optical alignment when the detector assembly is aimed at a position spaced from the target.

As shown in FIG. 3, any light rays R from the flash lamp 11 which are received by the lens 26 will be focused through the aperture 32 to the photodiode 30 so long as the axis of the detector assembly 18 is aligned with the target 13. When the detector assembly is pointed in a direction away from the target 13, as shown in FIG. 4, the rays R from the flash lamp which are received by the lens 26 will be focused upon the opaque mask 28, and thus, the radiation will be blocked from the photodiode 30. One type of objective lens 26 which may be used with the detector assembly of the present invention is a catadioptric lens, such lens having a relatively long focal length and a relatively short physical length. Such catadroptric lenses are generally available in stores which sell photographic equipment.

Figure 2:
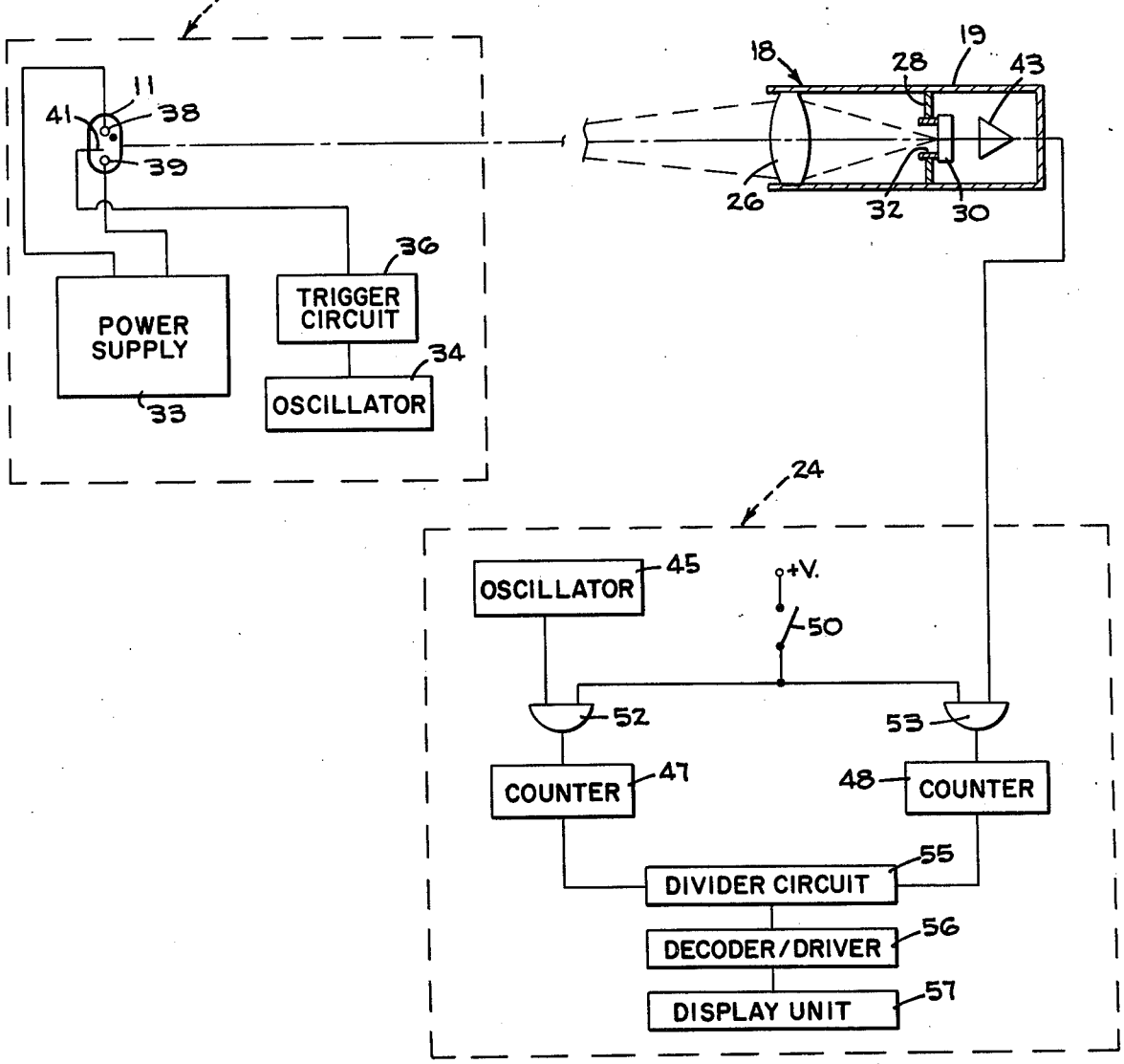
FIG. 2 is a block diagram representation of the circuitry and the detector assembly of the system of the present invention.

FIG. 2 discloses the circuitry used to operate the system of the present invention. The system, as seen in FIG. 2, includes an optical transmitter 20 (located at the target 13) which develops the periodic flashes, the detector assembly 18 which develops signals from the flashes which are received at the gun, and a processor module 24 (located at the gun 17) which counts the number of flashes received by the detector assembly and compares this number with the number of flashes that are produced at the target.

The optical transmitter 20, which is mounted on the target, includes the xenon flash lamp 11, a DC power supply 33, and a trigger unit which is comprised of an oscillator 34 and a trigger circuit 36. The DC power supply 33 supplies voltage between a pair of electrodes 38 and 39 in the lamp to provide the power which flashes the lamp each time a trigger pulse is applied to a trigger electrode 41. The oscillator 34 supplies pulses to the trigger circuit 36 which, in turn, amplifies the pulses and provides larger amplitude trigger pulses to the trigger electrode 41. These trigger pulses cause the xenon lamp to flash at the frequency of the oscillator pulses.

The xenon flash lamp provides intense flashes of radiant energy having a very short time duration and with a relatively low repetition rate. For example, the lamp may flash at a rate of 25 times per second with each flash having a time duration of only (approximately) 3 microseconds. Thus, the dury cycle (or percent of time that the lamp is conducting) is very low. As a result of this low duty cycle the amount of power required to provide the intense flashes of radiant energy is relatively low. The flashes of energy can be easily received over distances greater than 1 mile using an *f*/8 catadioptric lens 26 having a focal length of 500 mm and a silicon photodiode 30 such as the CL1278 made by CBS Labs of Stamford, Connecticut. One type of catadioptric lens which may be used is a Reflex Nikkon 500 mm, *f*/8 lens of the type used with the readily available Nikkon 35 mm cameras.

The optical transmitter 20 may be built as a single unit with the power supply 33, trigger circuit 36 and oscillator 34 as shown in FIG. 2, or a flash unit containing the xenon flash lamp 11 and the power supply 33 may be purchased separately as a single unit. One such available unit is the Stroboslave model 1539A built by the General Radio Company of Concord, Massachusetts.

When the detector assembly 18 is properly aligned with the target 13 (FIG. 3) each of the flashes of light from the xenon flash lamp 11 causes the photodiode 30 to develop a voltage pulse which is amplified by the amplifier 43 and applied to the processor module 24.

The processor module 24 includes a local oscillator 45 which is adapted to operate at the same frequency as the target oscillator 34. The oscillators 34 and 45 may be crystal controlled to insure that they do operate at the same frequency. Thus, for a given period of time each of the oscillators 34 and 45 will provide substantially the same number of output pulses. When a switch 50 is closed a voltage +V enables an AND-gate 52 so that the pulses from the oscillator 45 are coupled through the gate 52 to a counter 47 which continuously counts the number of pulses that are provided by the oscillator. At this same time a second AND-gate 53 is enabled so that another counter 48 is connected to the output of the amplifier 43 to count the number of flashes which are received by the detector assembly 18. Closing the switch 50 and then opening the switch simultaneously enables and then disables both of the AND-gates 52 and 53 so that both of the counters 47 and 48 are connected to their respective signal sources for the same period of time.

If the detector assembly 18 is properly trained on the flashing xenon lamp 11 during the time that the gates 52 and 53 connect the counters to the respective signal sources, counter 47 and counter 48 will each have the same number of counts for the period of time that the system is evaluated. If, however, the detector assembly is aimed at the target during only a portion of the time the controls are being evaluated only such portion of the lamp flashes will be received by the photodiode 30 so that the numerical count in counter 48 will be less than the count in counter 47.

A binary divider circuit 55 is used to continuously divide the numerical count produced by the counter 47 into the numerical count produced by the counter 48 and to thereby calculate the percent of time that the gun 17 is accurately trained on the target 13. The divider circuit 55 then provides a binary output signal to a decoder/driver circuit 56. The decoder/driver circuit 56 provides signals which cause a digital display unit 57 to display the percent of the time that the gun is properly trained on the target.

It will be seen that the aforedisclosed real-time system for measuring the time-on-target of a weapon provides a quick and continuous evaluation of the accuracy in aiming the weapon. A final answer to the performance of the weapon is available just as soon as the evaluation time is completed. This real-time system of the present invention may be used to evaluate weapons stabilizing systems, or it may be used to evaluate the performance of the individuals who are controlling the movements of the weapons.

Although the best mode contemplated for carrying out the present invention has been herein shown and described, it will be apparent that modification and variation may be made without departing from what is regarded to be the subject matter of the invention.

What is claimed is:

1. A real-time system for automatically evaluating the performance of a weapon by measuring the percentage of time that the weapon is trained on a target, said system comprising:

a pulsating light source mounted on said target;

means for energizing said light source at a predetermined pulse rate;

photodetector means mounted at said weapon;

means for directing flashes of radiant energy from said light source to said photodetector means when and only when said weapon is aimed at said target;

means for counting the number of pulses produced at said predetermined pulse rate during the time period that said weapon is evaluated;

means for counting the number of flashes of radiant energy that are received from said light source by said photodetector means during said evaluation time period; and means for comparing the counts in said two different counting means to provide information indicative of the percentage of time that the weapon is aimed at said target during said evaluation time period.

2. A real-time system for automatically evaluating weapon performance as defined in claim 1 wherein said means for energizing said light source includes a trigger oscillator for developing trigger pulses at said predetermined pulse rate, and means for coupling said trigger pulses to said light source.

3. A real-time system for automatically evaluating weapon performance as defined in claim 1 wherein said means for directing flashes of radiant energy to said photodetector means includes an objective lens, a mask having a transparent aperture therein, and means for mounting said mask substantially at the focal plane of said lens with said photodetector means being mounted adjacent said aperture.

4. A real-time system for automatically evaluating weapon performance as defined in claim 1 wherein said means for counting the number of pulses produced during the evaluation time includes a local oscillator located at said weapon and having an output frequency substantially equal to said predetermined pulse rate of said light source, and a first counter for counting the number of pulses developed by said oscillator during said evaluation time period.

5. A real-time system for automatically evaluating weapon performance as defined in claim 4 wherein said means for counting the received flashes of light includes a second counter for counting the number of said signal pulses developed by said photodetector means, and gating means for connecting said second counter to said photodetector means during said evaluation time period and for concurrently connecting said first counter to said local oscillator during said evaluation time period.

6. A real-time system for automatically evaluating the performance of a weapon by measuring the percentage of time that the weapon is trained on a target, said system comprising:

a flash lamp mounted on said target;

means for energizing said lamp so that said lamp flashes at a predetermined rate;

photodetector means mounted at said weapon;

means for directing flashes of radiant energy from said flash lamp to said photodetector means when and only when said weapon is aimed at said target, said photodetector means having means for developing a signal pulse for each of said flashes of energy received;

signal generating means positioned at said weapon for developing oscillator pulses having a frequency substantially equal to the frequency of said lamp flashes;

first counting means for counting the number of oscillator pulses generated during the time period that said weapon is being evaluated; and second counting means for counting the number of signal pulses developed by said photodetector means during said evaluation time period.

7. A real-time system for evaluating weapon performance as defined in claim 6 including gating means for connecting said first counting means to said signal generating means during said evaluation time period and for connecting said second counting means to said photodetector means during said evaluation time period so that said first and said second counting means operate concurrently.

8. A real-time system for evaluating weapon performance as defined in claim 6 including circuit means for comparing the number of oscillator pulses generated during said evaluation time period with the number of signal pulses developed by said photodetector means during said evaluation time period.

9. A real-time system for evaluating weapon performance as defined in claim 8 wherein said comparing circuit means includes means for developing an output signal having a value which is determined by the ratio of the number of signal pulses developed during said evaluation time period and the number of oscillator pulses developed during the said evaluation time period.

10. A real-time system for evaluating weapon performance as defined in claim 9 including means connected to said comparing circuit means for displaying the percentage of time that said weapon is trained on said target in response to said output signal of said comparing circuit means.

* * * * *

UNITED STATES PATENT AND TRADEMARK OFFICE

CERTIFICATE OF CORRECTION

PATENT NO. : 4,097,156

DATED : Jun 27, 1978

INVENTOR(S) : ARNOLD L. GARBER et al

It is certified that error appears in the above—identified patent and that said Letters Patent is hereby corrected as shown below:

Column 3, line 38: change "dury" to --duty--

Signed and Sealed this

*Nineteenth* Day of *May 1981*

[SEAL]

*Attest:*

RENE D. TEGTMEYER

*Attesting Officer*

*Acting Commissioner of Patents and Trademarks*